United States Patent [19]

Hein

[11] 4,080,979

[45] Mar. 28, 1978

[54] COMBINED SUMMING AND UNDERSPEED VALVE

[75] Inventor: Allyn J. Hein, Camdenton, Mo.

[73] Assignee: Caterpillar Tractor Co., Peoria, Ill.

[21] Appl. No.: 779,979

[22] Filed: Mar. 22, 1977

[51] Int. Cl.[2] ..... F04B 49/08

[52] U.S. Cl. ..... 137/118; 60/449; 417/216

[58] Field of Search ..... 137/117, 118; 60/447, 60/449; 417/213, 216

[56] References Cited

U.S. PATENT DOCUMENTS

| | | | |
|---|---|---|---|
| 3,543,508 | 12/1970 | Schwab | 60/449 |
| 3,732,036 | 5/1973 | Busbey | 417/216 |
| 3,841,795 | 10/1974 | Ferre | 417/216 |

*Primary Examiner*—Robert G. Nilson
*Attorney, Agent, or Firm*—Wegner, Stellman, McCord, Wiles & Wood

[57] ABSTRACT

A combined summing and underspeed valve including a valve body having a bore, a spool within the bore, an outlet from the bore in the body intermediate the ends of the bore, a pair of spaced inlets in the bore for receiving fluid under pressure to apply force to opposite ends of the spool, at least two additional inlets in the body for receiving fluid under pressure to apply force to one of the ends of the spool, and pistons for isolating fluid from the inlet of the pair applying force to the spool one end from fluid from the additional inlets while applying force to the spool.

9 Claims, 1 Drawing Figure

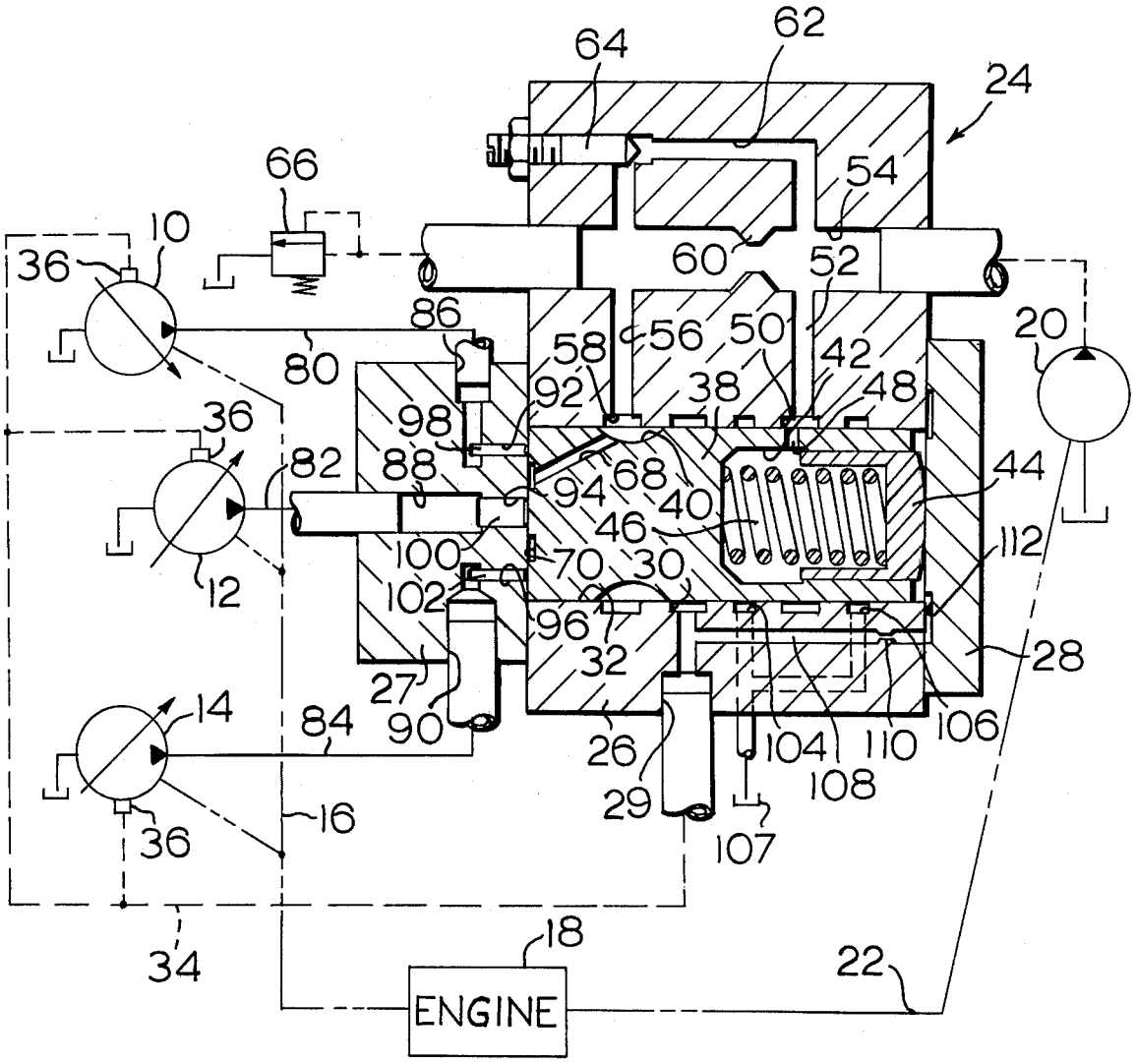
64
62
24
66
54
10
36
60
52
86
20
80
58
56
50
42
92
38
48
36
98
82
88
94
68
40
44
46
100
70
30
112
12
102
96
32
28
27
14
84
90
26
104
110
106
108
29
16
36
107
34
18
22
ENGINE

COMBINED SUMMING AND UNDERSPEED VALVE

BACKGROUND OF THE INVENTION

This invention relates to a combined summing and underspeed valve for use in hydraulic systems.

Many hydraulic systems used in work performing apparatus as, for example, hydraulic excavators, utilize a plurality of variable displacement pumps, one for each work function to be performed, driven by a single prime mover, such as an internal combustion engine.

In the usual case, the engine will be manually set to operate at a predetermined or normal operating speed and the various variable displacement pumps will be commanded to maximum displacement. In some cases, the loading on the engine may increase to the point where it begins to lug and its speed falls below the normal speed, while in other cases, one or more of the work performing systems may be overloaded, causing the development of a high back pressure within its individual hydraulic system.

In either case, it is desirable to relieve the overload condition by lessening the displacement of the pumps.

Conventionally, systems employed for accomplishing the foregoing function have utilized two valves, one being an underspeed valve and the other being a summing valve. See, for example, U.S. Letters Pat. No. 3,841,795, issued Oct. 15, 1974 to Ferre et al. This approach, while perfectly satisfactory in terms of accomplishing the intended function, is expensive in that two valves, a summing valve and an underspeed valve, must be utilized.

SUMMARY OF THE INVENTION

The present invention is addressed to overcoming one or more of the above problems.

According to the present invention, there is provided a combined summing and underspeed valve which includes a valve body having a bore. A spool is disposed within the bore and there is an outlet from the bore in the body intermediate the ends of the bore. A pair of spaced inlets are in the bore for receiving fluid under pressure to apply force to opposite ends of the spool and there are provided at least two additional inlets in the body for receiving fluid under pressure to apply force to one of the ends of the spool. There are further provided means for isolating fluid from the inlet of the pair applying force to the spool one end from fluid from the additional inlets.

Other objects and advantages will become apparent from the following specification taken in connection with the accompanying drawing.

DESCRIPTION OF THE DRAWING

The FIGURE is a somewhat schematic, sectional view of a combined summing and underspeed valve made according to the invention and illustrating, also schematically, other components of a hydraulic system with which the valve will typically be utilized.

DESCRIPTION OF THE PREFERRED EMBODIMENT

An exemplary embodiment of a combined summing and underspeed valve made according to the invention is illustrated in the FIGURE in connection with the hydraulic system embodying a plurality of variable displacement plumps 10, 12 and 14, all driven by a mechanical connection, shown schematically at 16, to a single prime mover, such as an engine 18. The engine 18 also will typically drive a fixed displacement pump 20 by means of a mechanical connection thereto, shown schematically at 22.

The valve of the present invention includes a valve body, generally designated 24, comprised of a central body or casting 26 flanked by end caps 27 and 28. The central casting 26 includes an outlet 29 in fluid communication with an annulus 30 on the interior of a bore 32 within the central casting 26. As will be seen, fluid under pressure may be directed to the outlet 29 whence it will flow along a conduit 34 to the hydraulic actuators 36 of each of the pumps 10, 12 and 14 to lessen their displacement in a conventional manner.

A spool 38 is slidably received within the bore 32 and includes an annular groove 40 adjacent one end and an interior bore 42 opening to the opposite end. A piston 44 is slidably received within the bore 42 and a coil spring 46 is interposed between the end of the bore 42 and the piston 44 to bias the latter toward the end cap 28 and to bias the spool 38 toward the end cap 27. The spool further includes one or more radially extending ports 48 which establish fluid communication between the exterior of the spool and the interior of the bore 42.

The port or ports 48 are disposed to be in fluid communication with an annulus 50 on the interior of the bore 32 which, in turn, is in fluid communication with an inlet 52. The inlet 52 extends to a conduit 54 which, in turn, may receive the output of the fixed displacement pump 20. A second inlet 56 is also connected to the conduit 54 and opens to an annulus 58 in the bore 32 at the location of the groove 40 in the spool 38.

The conduit 54 includes a flow restricting orifice 60 therein and an additional conduit 62 is connected in parallel to conduit 54 across the orifice 60. An adjustable needle valve 64 provides a variable flow restriction in the conduit 62. The end of the conduit 54 downstream from the second inlet 56 is connected to a conventional pressure relief valve 66 to prevent over-pressurization and maintain a constant pressure in the downstream end of conduit 54 equal to pressure setting of valve 66.

Returning to the groove 40 in the spool 38, there is provided one or more conduits 68 within the spool 38 opening to the groove 40 and to an annular groove 70 in the end of the spool 38 adjacent the end cap 27. Thus, the right-hand end of the spool 38, as viewed in the FIGURE, will be subjected to two pressures; the pressure within inlet 52 will apply over the bore 42 area, and the pressure in groove 112 will apply over the spool annulus area from bore 42 outward to the O.D. of spool 38. The left-hand end of the spool 38 will be subjected to the pressure of fluid within the inlet 56. The valves will be different due to the presence of the orifices 60 and 64 dependent upon the flow rate through the conduits 54 and 62. Since the pump 20, which supplies such conduits with fluid under pressure, is a fixed displacement pump, for greater engine speeds, the flow rate will be relatively large and a large pressure drop will exist while for lower engine speeds, there will be a decrease in the flow rate and a lesser pressure drop.

When the engine is operating at its normal speed, through suitable adjustment of the orifice 64, the pressure drop can be made such that the sum of the forces applied to the right-hand side of the piston by the spring 46 and the fluid flowing in the inlet 52 will be greater than the sum of the forces applied through the left-hand end of the spool 38 causing the spool 38 to assume the position illustrated in the FIGURE with the result that all of the pumps 10, 12 and 14 will be operating at maximum displacement since fluid cannot flow to the outlet 29. Conversely, when the force applied to the left-hand end of the spool 38 exceeds that applied to the right-hand end as, for example, due to a decrease in the flow rate within the conduits 54 and 62 due to a decrease in engine speed caused by lugging or the like, the spool 38 will shift to the right as viewed in the FIGURE to establish, in varying degrees, fluid communication from the inlet 56 to the outlet 29 thereby applying fluid under pressure to the actuators 36 of the pumps 10, 12 and 14 to cause the same to lessen their displacement.

Each of the pumps 10, 12 and 14 are connected by lines 80, 82 and 84 to additional inlet ports 86, 88 and 90, respectively, in the valve body 24 and, specifically, the end cap 27. Each of the additional inlets 86–90 is in fluid communication with an associated bore 92, 94 and 96 which open to the bore 32 and which are parallel to the longitudinal axis of the bore 32. The FIGURE shows single pistons 98 and 102, which are off center of spool 38, to illustrate principle. In practice, each off center piston must be a pair of pistons 180° apart to keep the abutting force on spool 38 balanced. The piston 100 is located co-axial with spool 38 and therefore only one piston is necessary. Pistons 98, 100 and 102 are slidably received in the bores 92, 94 and 96 and abut against the left end of the spool 38. The pistons 98, 100 and 102 act to communicate the pressure in their associated inlet ports as a force to the spool 38 tending to move the same to the right, as viewed in the FIGURE, and will cause such movement, regardless of the flow rate from the fixed displacement pump 20 whenever the sum of the pressure forces indicates a demand for a torque greater than that can be provided by the engine 18. When such movement occurs, fluid from the fixed displacement pump 20 will be directed to the outlet 29 to cause a lessening of the displacement of the pumps 10, 12 and 14.

It will be observed that the pistons 98, 100 and 102 isolate the fluid from the inlet 56 from each of the inlets 86, 88 and 90 as well as from each other.

The valve further includes spaced annuli 104 and 106 opening to the bore 32 and connected to a reservoir 107. In this connection, in some instances, it may be desirable to provide a further groove to the right of the groove 40 in the spool 38 to establish fluid communication between the annulus 30 and the annulus 104 when the valve is in the position illustrated in the FIGURE to relieve hydraulic pressure in the actuators 36 of the pumps 10, 12 and 14.

Additionally, there is provided a conduit 108 which extends from the outlet 29 through a fluid flow restriction or orifice 110 to an annular groove 112 in the end cap 28 which opens to the bore 32 adjacent the right-hand end of the spool 38. When fluid is flowing from the inlet 56 to the outlet 29, the pressure thereof will be applied to the piston 44 and the outer annulus of spool 38. The application of such pressure stabilizes the spool 38 in a particular position to provide smooth control action.

From the foregoing, those skilled in the art will appreciate that all of the functions heretofore obtained in systems utilizing separate summing and underspeed valves are attained in a single valve structure made according to the invention. It will also be recognized that through the use of a single valve structure, a considerable number of parts have been eliminated over two valve systems, allowing a considerable cost saving without giving away system performance.

The embodiments of the invention in which an exclusive property or privilege is claimed are defined as follows:

1. A combined summing and underspeed valve comprising:

a valve body having a bore;

a spool within said bore;

an outlet from said bore in said body intermediate the ends of said bore;

a pair of spaced inlets in said bore for receiving fluid under pressure to apply force to opposite ends of said spool;

at least two additional inlets in said body for receiving fluid under pressure to apply force to one of said ends of said spool; and means for isolating fluid from the inlet of said pair applying force to said spool one end from fluid from said additional inlets.

2. The valve of claim 1 wherein said isolating means comprise a plurality of pistons, one for each additional inlet, in engagement with said spool one end.

3. The valve of claim 1 further including a feedback conduit in said body extending from said outlet to the end of said bore adjacent said spool one end.

4. The valve of claim 3 further including a flow restriction in said conduit.

5. The valve of claim 1 including a conduit in said body interconnecting the inlets of said pair, and a flow restriction in said conduit.

6. The valve of claim 5 including an additional conduit within said body and connected in parallel with said conduit and having a variable flow restriction therein.

7. A combined summing and underspeed valve comprising:

a valve body having a bore;

a spool within said bore;

an outlet from said bore in said body intermediate the ends of said bore;

a pair of spaced inlets in said bore for receiving fluid under pressure to apply force to opposite ends of said spool;

one of said inlets extending to a groove in said spool for allowing fluid flow from said one inlet to said outlet, said spool further including a conduit extending from said groove to one end of the spool and opening thereat; and at least two additional inlets in said body for receiving fluid under pressure and having pistons engaging said spool one end.

8. The valve of claim 7 wherein the other end of the spool is abutted by a biasing spring.

9. The valve of claim 7 wherein the other end of said spool includes a bore, a piston slidable within said spool bore, a spring interposed between said spool and the slidable piston within the bore, and a conduit extending from said outlet to the bore in said valve body adjacent said spool other end.

* * * * *